US005421053A

United States Patent [19]

Chodak

[11] Patent Number: 5,421,053

[45] Date of Patent: Jun. 6, 1995

[54] REMOVABLE BRUSH COUPLING

[75] Inventor: Keith W. Chodak, Southern Pines, N.C.

[73] Assignee: AAR Corp., Elk Grove Village, Ill.

[21] Appl. No.: 234,041

[22] Filed: Apr. 28, 1994

[51] Int. Cl.[6] ..... E01H 1/02; A47L 11/283; F16B 21/07

[52] U.S. Cl. ..... 15/87; 15/49.1; 15/180; 403/327

[58] Field of Search ..... 15/49.1, 50.1, 180, 15/98, 385, 340.3, 340.4, 87; 403/325, 326, 327, 377; 51/177

[56] References Cited

U.S. PATENT DOCUMENTS 1,881,431 10/1932 Finnell .
1,881,432 10/1932 Finnell ..... 15/180
1,933,846 7/1933 Finnell ..... 15/49.1
2,561,279 7/1951 Holt .
2,727,262 12/1955 Gerber .
2,733,465 2/1956 Holt .
2,870,468 1/1959 Barel .
2,960,705 11/1960 Nilsson et al. .
3,019,465 2/1962 Bayless .
3,055,030 9/1962 Ardito .
3,082,451 3/1963 Smithson .
3,122,765 3/1964 Magarian .
3,264,674 8/1966 Doyle, Jr. et al. .
3,284,830 11/1966 Kroll .
3,401,416 9/1968 Ziegler .
3,407,422 10/1968 Otto et al. .
3,458,885 8/1969 Danielsson .
3,490,087 1/1970 Krier et al. .
3,562,843 2/1971 Belicka et al. .
3,600,735 8/1971 Jerabek .
3,979,789 9/1976 Peabody et al. .
3,996,636 12/1976 Ashton ..... 15/87
4,094,034 6/1978 Wilkins et al. .
4,096,599 6/1978 Mayo .
4,251,896 2/1981 Block .
4,476,602 10/1984 Hurn et al. .
4,603,999 8/1986 Laditka .
4,773,120 9/1988 Wang .
4,866,804 9/1989 Masbruch et al. .

*Primary Examiner*—Edward L. Roberts, Jr.
*Attorney, Agent, or Firm*—Harness, Dickey & Pierce

[57] ABSTRACT

A coupling for removably affixing a brush to a rotatable drive shaft includes a drive hub affixed to the drive shaft, in which an axial projection having a cam surface is disposed on either the drive hub or the brush. The other of the hub and the brush defines a recess for accepting the projection and has a spring retainer affixed thereto. The projection and recess have an interfitting spline connection for preventing relative rotation between the drive hub and the brush. The cam surface is adapted to elastically spread the retainer to allow-the projection to be inserted within the recess. The retainer thereafter engages the shelf surface to prevent removal of the projection from the recess. The spring retainer is provided with tabs for elastically spreading the retainer to disengage the shelf surface and allow the brush to be easily removed from the drive hub.

18 Claims, 3 Drawing Sheets

REMOVABLE BRUSH COUPLING

BACKGROUND AND SUMMARY OF THE INVENTION

This invention relates generally to couplings, and more particularly to a unique coupling for removably affixing a brush to a drive shaft.

Rotating brushes are used in a variety of devices, such as cleaning vehicles, polishing machines, and automated car washing machines. However, the brushes invariably wear out after an extended period of use. At such a time, the bristles, fibers, blades, or wipers of the brush become worn or stiff, or otherwise unusable. As a result, rotating brush machines have been provided with various devices for removably affixing a brush to a drive shaft. Such detachable couplings have included breakable retainers, releasable latches, bayonet retainers, snaps, and clasps. In addition, various snap rings and spring clips have been provided.

However, removable brush couplings have generally relied on the application of a relatively high force to remove the brush from the drive hub. In other words, the couplings generally provide no means for easily uncoupling or releasing the engagement and removing the brush. This technique may be difficult for an operator to perform, or may result in a component of the coupling breaking while the brush is removed. It is therefore desirable to provide a coupling for removably affixing a brush to a drive hub which includes releasing means for alleviating the engagement of the coupling, thereby allowing the brush to be easily removed from the drive hub.

Accordingly, the coupling of the present invention provides a novel configuration for a drive hub and a brush, wherein either the drive hub or the brush head is provided with an axially extending projection having a cam surface, while the other defines a recess for receiving the projection and is affixed to a spring retainer. The recess and projection have an interfitting spline connection to prevent relative rotation between the brush and the drive hub. The cam surface is adapted to elastically spread the spring retainer to allow the projection to be inserted within the recess. The retainer thereafter engages the projection to prevent removal of the projection from the recess. The spring retainer is provided with tabs for manually adjusting the spring retainer to an open position in which it no longer engages the projection, allowing the projection to be easily removed from the recess. The coupling of the present invention also allows a brush to be easily reattached to the hub.

It is therefore an object of the present invention to provide a coupling for removably affixing a brush to a drive hub having releasing means for releasing the coupling to allow easy removal of the brush from the drive hub, whereby the aforementioned problems encountered with known couplings are overcome.

These and other advantages and features will become apparent from the following description and claims in conjunction with the accompanying drawings.

DETAILED DESCRIPTION OF THE PREFERRED EMBODIMENTS

The following description of the preferred embodiment is merely exemplary in nature, and is in no way intended to limit the invention or its application or uses.

Figure 1:
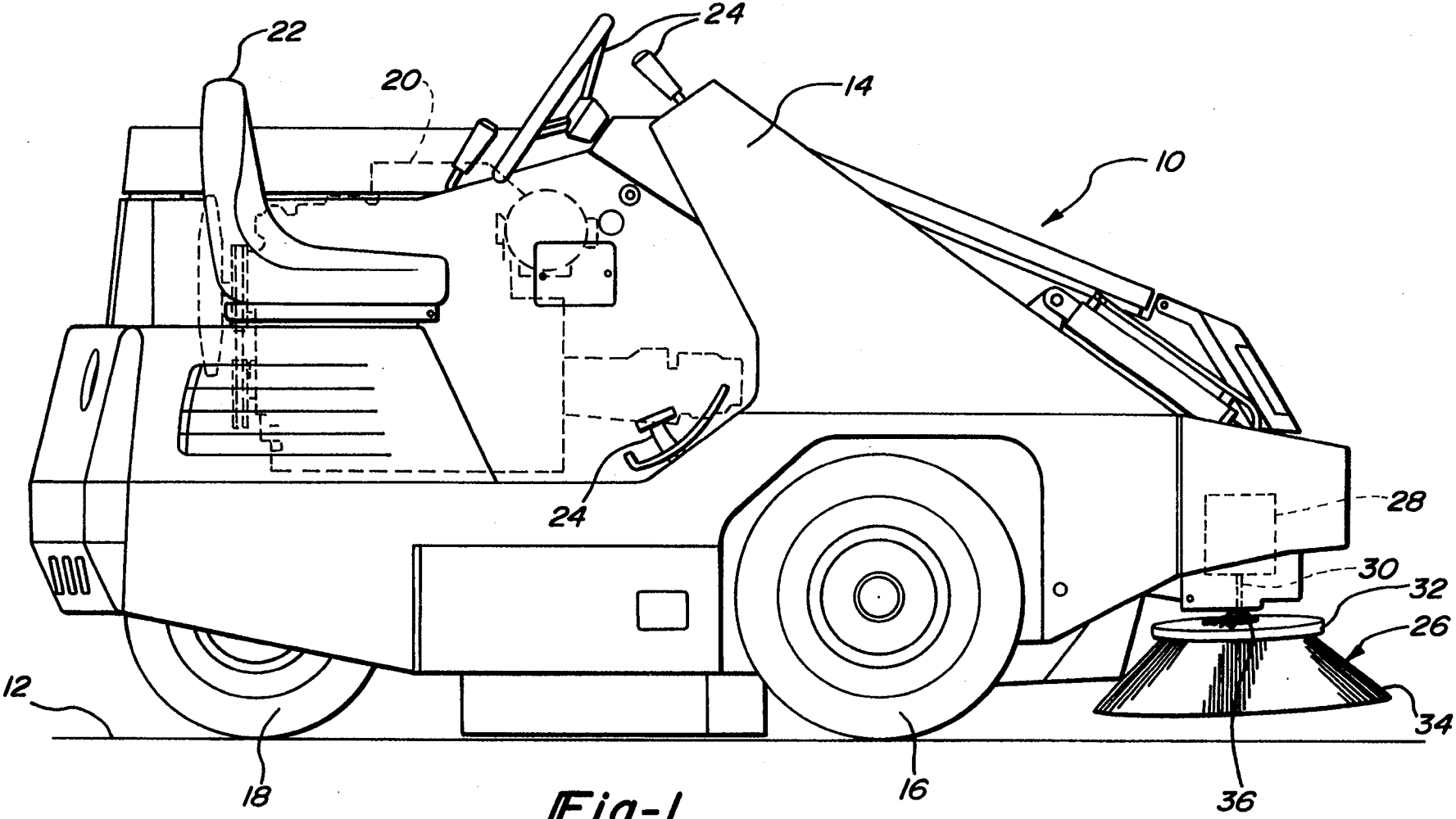
FIG. 1 is a side elevational view of a cleaning vehicle incorporating a coupling according to the principles of the present invention.

With reference to the drawings, FIG. 1 shows a cleaning vehicle 10 for cleaning a surface 12 having a body 14, a pair of driving wheels 16, a rear steering wheel 18, an engine 20 for moving vehicle 10 upon surface 12, an operator's chair 22, a conventional arrangement of controls 24 for controlling the operation of vehicle 10, and a rotatable brush 26 disposed at the front of vehicle 10 for sweeping and cleaning surface 12. A motor 28 is provided for rotating a drive shaft 30 and thereby for rotating brush 26 when one is affixed thereto. Brush 26 is formed of a brush head 32 and a multiplicity of bristles 34 which are affixed to brush head 32 by any known method. Brush head 32 is preferably formed of a hard plastic or other rigid material, while bristles 34 may be made of any of a variety of flexible materials. Of course, brush 26 may be of various types, in which axially extending bristles 34 are replaced by rubber blades, radially extending bristles, or strips of cloth, for example.

The novel coupling 36 of the present invention is shown in greater detail in FIGS. 2–7 and is capable of removably affixing brush 26 to drive shaft 30, while providing manually actuable releasing means for alleviating the engagement of coupling 36 to allow brush 26 to be easily removed from drive shaft 30. Brush 26 may then be replaced by a new brush, or may be reattached to drive shaft 30. The present invention thus provides a unique apparatus for rigidly coupling brush 26 to drive shaft 30 simply by pushing brush 26 into position, where coupling 36 elastically and automatically engages brush 26. Coupling 36 can then be manually released, and brush 26 easily removed, in a one-step operation.

Figure 2:
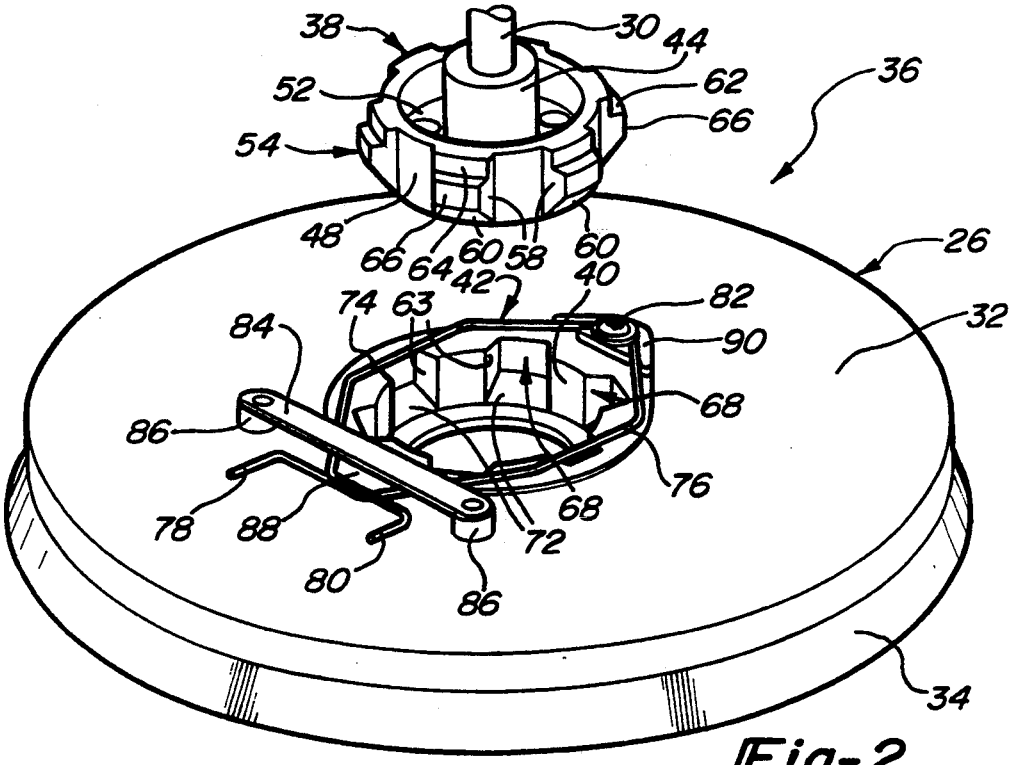
FIG. 2 is a perspective view of a coupling according to the present invention.
Figure 5:
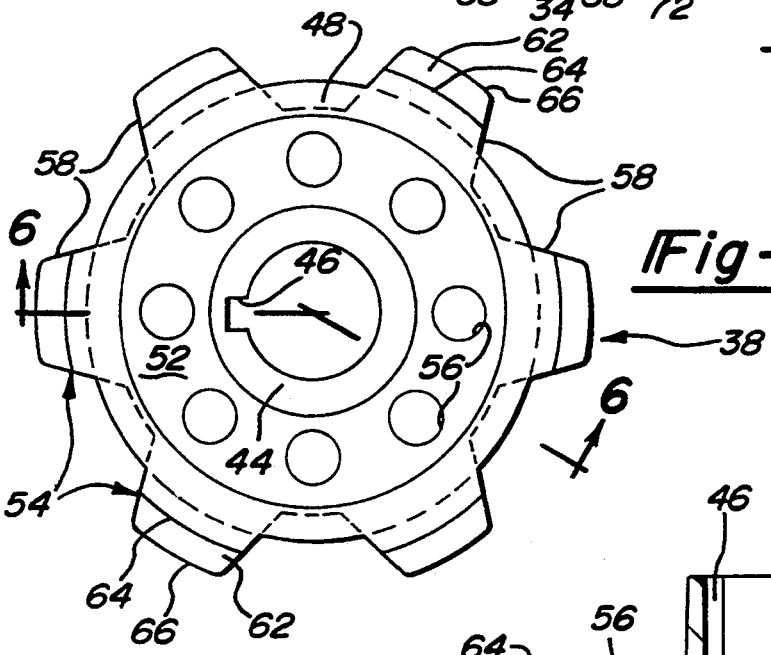
FIG. 5 is a top plan view of a drive hub according to the present invention.
Figure 6:
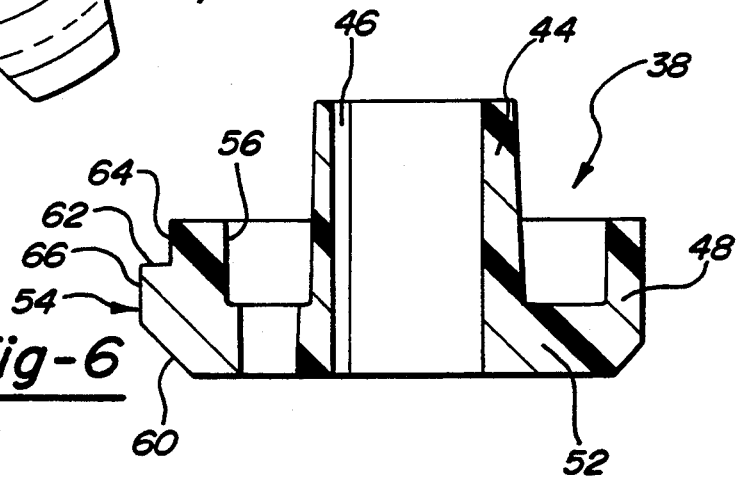
FIG. 6 is a vertical cross-sectional view of the drive hub shown in FIG. 5, taken generally along lines 6—6.

Coupling 36 generally constitutes an axial projection extending from a drive hub 38 which is non-rotatably affixed to an end of drive shaft 30, a recess 40 formed on brush head 32 which is adapted to accept drive hub 38, and a spring retainer 42 affixed to brush head 32 for selectively engaging and releasing drive hub 38. Drive hub 38 has a cylindrical collar 44 which surrounds the end of drive shaft 30, a keyway 46 formed in collar 44 for receiving and engaging a key 50 affixed to drive shaft 30, an annular ring 48, a disc 52 extending between collar 44 and ring 48, and a series of preferably six splines 54 projecting radially outward from ring 48. Disc 52 has a number of passages 56 extending therethrough. Splines 54 are each formed with torque applying surfaces 58, cam surfaces 60, shelf surfaces 62, stop surfaces 6,4, and relief surfaces 66. Drive hub 38 may be formed having several cam surfaces 60 and several shelf surfaces 62, or only one, or a combination thereof. Cam surfaces 60 are inclined with respect to relief surfaces 66 and an axis of rotation of drive shaft 30. Shelf surfaces 62 are orthogonal to and extend radially outward from longitudinally extending stop surfaces 64. Longitudinally extending relief surfaces 66 are substantially parallel to stop surfaces 6,4 and are disposed between cam surfaces 60 and shelf surfaces 62. Cam surfaces 60 are disposed at an axial end or distal portion of splines 54, while shelf surfaces 62 and stop surfaces 64 are disposed at an axially opposite end of splines 54. Of course, shelf surfaces 62 and stop surface 64 may be disposed on splines 54 as shown in FIGS. 2, 5, and 6, or elsewhere on drive hub 38, such as on annular ring 48. The preferred configuration of drive hub 38, having collar 44, ring 48, and disc 52 with passages 56, rather than a solid block of material, is thus strong yet lightweight.

Recess 40 formed in brush head 32 has a matching series of preferably six splineways 68 having torque receiving surfaces 70 for receiving, mating with, and directly engaging splines 54 to prevent relative rotation between brush head 32 and drive hub 38. Hub 38 and recess 40 thus form an interfitting spline connection. Splineways 68 preferably also have inclined surfaces 72 which match inclined cam surfaces 60 when drive hub 38 is inserted within recess 40. In an alternative embodiment, the drive hub may be formed with a recess similar to recess 40, and the brush head may accordingly have an axial projection having cam surfaces and shelf surfaces similar to the axial end projection of drive hub 38.

Figure 3:
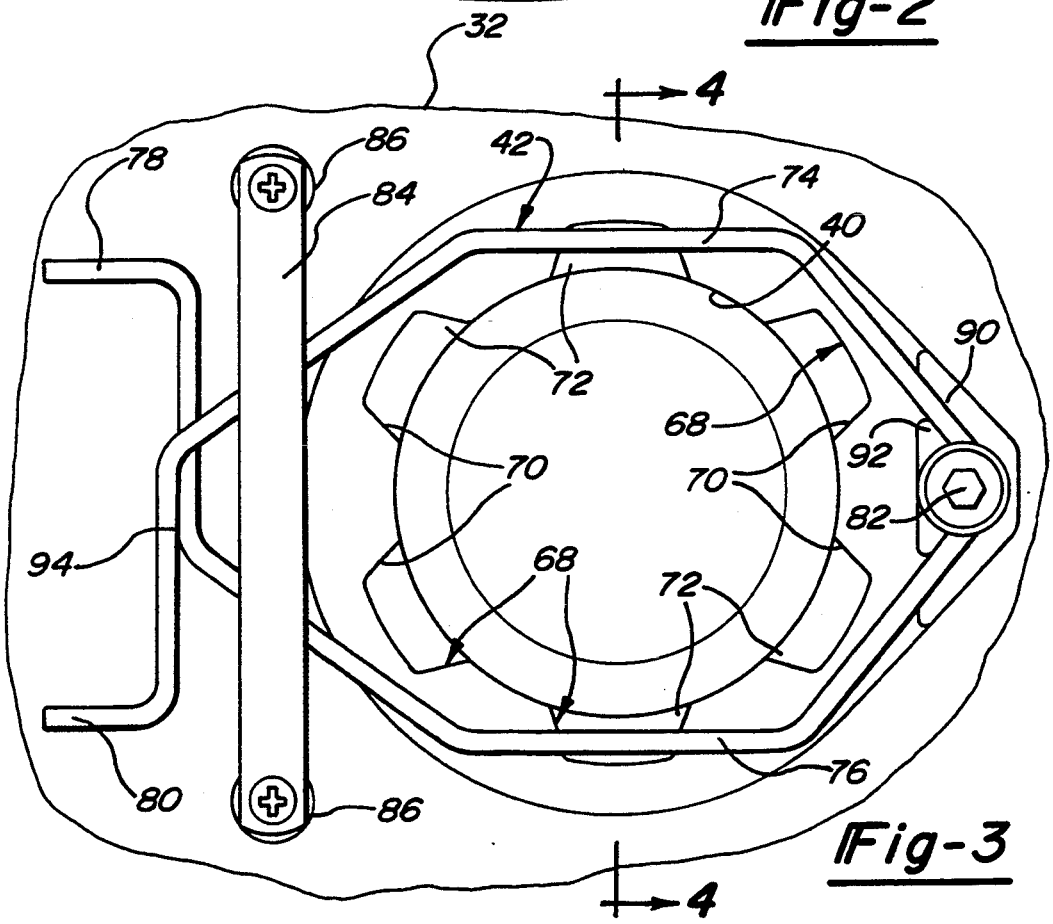
FIG. 3 is a top plan view of a brush according to the present invention.

Spring retainer 42 is mounted to brush head 32 and preferably has an approximately hexagonal shape and is formed of a heavy gage wire. If the recess and axial projection are disposed alternatively on the drive hub and brush head respectively, retainer 42 should be affixed to the drive hub. Spring retainer 42 has two legs 74 and 76 and two outwardly extending tabs 78 and 80. Tabs 78 and 80 are preferably formed as shown in FIGS. 2 and 3, wherein legs 74 and 76 are crossed at an intersection point 94 disposed between legs 74 and 76 and tabs 78 and 80, so that inward movement of both tabs 78 and 80 will cause outward extension of legs 74 and 76. Retainer 42 is affixed to brush head 32 by an anchor 82 which firmly affixes a central portion of spring retainer 42 between legs 74 and 76 to brush head 32. Anchor 82 holds retainer 42 to brush head 32 in the arrangement shown in FIGS. 2 and 3. The opposite end of retainer 42 from the portion affixed to anchor 82 is prevented from moving in an axial or transverse direction by a metal strap 84 supported and mounted to brush head 32 by pedestals 86 to form a laterally extending channel 88 through which legs 74 and 76 extend. Channel 88 thus allows legs 74 and 76 to move laterally outward or inward, while restricting legs 74 and 76 to a narrow limited range of axial motion. Anchor 82 and channel 88 thus cooperate to affix retainer 42 to brush head 32, thereby supporting both ends of legs 74 and 76 against axial loads and preventing retainer 42 from breaking away axially from brush head 32. Recess 40 is disposed between anchor 82 and channel 88, so that retainer 42 surrounds recess 40.

Figure 4:
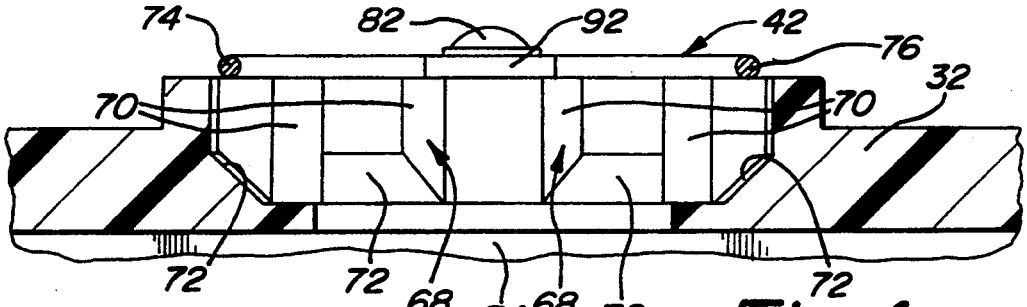
FIG. 4 is a partial vertical cross-sectional view of a brush according to the present invention taken generally along lines 4—4 in FIG. 3.

A pair of guide members 90 and 92 are provided to prevent retainer 42 from rotating with respect to recess 40, and in the embodiment shown in FIGS. 2–4, to brush head 32. Guide members 90 and 92 allow legs 74 and 76 to move laterally inward and outward. In the normal relaxed or initial position of retainer 42 shown in FIGS. 2 and 3, each leg 74 and 76 covers one of a radially opposed pair of splineways 68. In other words, a portion of each leg 74 and 76 is disposed radially and laterally inward of a portion of the opposed pair of splineways 68. Of course, retainer 42 could be constructed so as to cover more than two of the splineways 68. Legs 74 and 76 tend to remain in a relaxed position with respect to each other, and guide members 90 and 92 cooperate with anchor 82 to maintain retainer 42 in alignment with recess 40. Legs 74 and 76 therefore tend to remain in the initial position shown in FIGS. 2 and 3.

Figure 7:
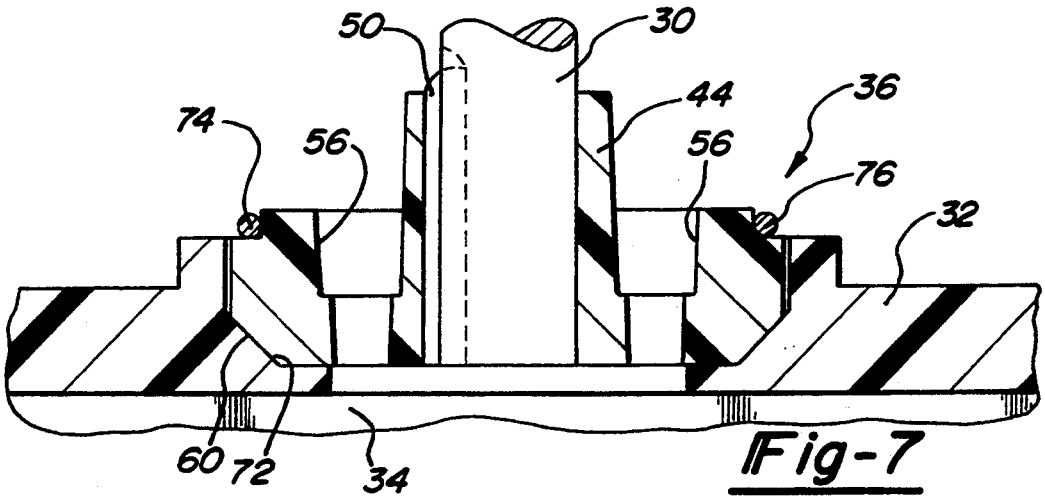
FIG. 7 is a partial vertical cross-sectional view of an assembled coupling according to the present invention.

Brush 26 is affixed to drive shaft 30, and drive hub 38 is trapped within recess 40 simply by pushing brush 26 in an axial, affixing direction toward drive hub 38. When cam surfaces 60 meet legs 74 and 76 of retainer 42, they will cam or ramp legs 74 and 76 to elastically spread them laterally outward from the initial position shown in FIGS. 2 and 3 to allow drive hub 38 to be inserted within recess 40. After cam surfaces 60 have spread legs 74 and 76, relief surfaces 60 will retain legs 74 and 76 in the open or spread position until legs 74 and 76 meet shelf surfaces 62. Legs 74 and 76 will then elastically snap laterally inward until they strike stop surfaces 64 and assume an engaged position, as shown in FIG. 7. Legs 74 and 76 then lockingly engage shelf surfaces 62 to prevent removal of drive hub 38 from recess 40. In other words, coupling 36 will automatically engage and affix brush 26 to hub 38 when brush is pushed on. No manual engagement of any latch, lever, clasp, or catch is required. In addition, shelf surfaces 6,2 preferably define an angle of at least 90 degrees with respect to an axis of rotation of drive shaft when the axial end projection defined by drive hub 38 is inserted within recess 40, so that shelf surfaces 62 tend not to cam legs 74 and 76 outward and disengage coupling 36 when brush 26 is pulled in a removing direction. Legs 74 and 76 thus tend to remain engaged with shelf surfaces 62, thereby preventing removal of hub 38 from recess 40 and therefore brush 26 from drive shaft 30.

Coupling 36 is also adapted to maintain a constant angle, preferably of zero degrees, between the axis of rotation of drive shaft 30 and an axis normal to a plane defined by brush head 32. In other words, coupling 36 is adapted to rigidly affix brush 26 to drive shaft 30 and to prevent brush 26 from wobbling with respect to drive shaft 30. Brush 26 will therefore tend to remain aligned with surface 12 during operation of cleaning vehicle 10.

To remove brush 26 from drive shaft 30, or to remove drive hub 38 from recess 40, tabs 78 and 80 are manually pushed laterally inward to elastically spread legs 74 and 76 from the .engaged position to an open position in which legs 74 and 76 uncover splineways 68 and no longer engage shelf surfaces 62. Drive hub 38 may then be easily removed from recess 40. Indeed, in the cleaning vehicle arrangement shown in FIG. 1, brush 26 will fall off of drive shaft 30 due to gravity when tabs 78 and 80 are moved inward to alleviate the engagement of legs 74 and 76 with shelf surfaces 62.

Of course, brush 26 may be easily replaced or reattached to drive hub 38 in a similar manner. If brush 26 is again pressed onto drive hub 38, coupling 36 will automatically engage and removably affix brush 26 to drive shaft 30, after cam surfaces 60 spread legs 74 and 76 to admit hub 38 into recess 40, when legs 74 and 76 snap inward to engage shelf surfaces 62. As a result, the coupling 36 of the present invention provides a unique apparatus for both rigidly affixing, and then easily removing a brush 26 from a drive shaft 30 in simple, one-step operations, rather than requiring brute force to accomplish either attachment or removal.

It should be understood that the preferred embodiment of the invention has been shown and described herein, and that various modifications of the preferred embodiment will become apparent to those skilled in the art after a study of the specification, drawings and the followings claims.

What is claimed is:

1. A coupling for removably affixing a brush to a rotatable drive shaft, comprising:

a drive hub affixed to said drive shaft;

an axially extending projection disposed on one of said drive hub and said brush having a shelf surface and an inclined cam surface;

a recess defined by the other of said drive hub and said brush adapted to accept said projection;.

said projection and recess having a plurality of interfitting splines and splineways for preventing relative rotation between said brush and said hub; and a spring retainer affixed to the other of said hub and said brush which has first and second legs and tabs, said legs covering a diametrically opposed pair of said splineways when said legs are in an initial position;

said cam surface being adapted to elastically spread said legs from said initial position to allow said projection to be inserted within said recess, said legs thereafter engaging said shelf surface to prevent removal of said projection from said recess, said tabs being manually actuable to elastically-spread said legs to an open position in which said legs uncover said opposed pair of splineways, to allow said projection to be easily removed from said recess.

2. The coupling as claimed in claim 1, wherein said shelf surface defines an angle of at least 90 degrees with respect to said shaft when said projection is inserted within said recess, so that said legs tend to continue to engage said shelf surface.

3. The coupling as claimed in claim 1, wherein the other of said hub and said brush further comprises an anchor for rigidly affixing a portion of said spring retainer thereto, and a laterally extending channel through which said legs extend for restricting axial motion of said legs relative thereto, while allowing said legs to move laterally, to prevent removal of said projection from said recess.

4. The coupling as claimed in claim 3, further comprising guide means adapted to prevent relative rotation of said spring retainer with respect to said recess, such that said legs tend to remain in said initial position.

5. The coupling as claimed in claim 1, wherein said coupling maintains a constant angle between an axis of rotation of said shaft and an axis normal to a plane defined by said brush, thereby preventing said brush from wobbling with respect to said drive shaft.

6. The coupling as claimed in claim 1, wherein said recess is formed with an inclined surface formed to mate with said cam surface disposed on said projection.

7. The coupling as claimed in claim 1, wherein said legs cross at a point disposed between said legs and said tabs, so that inward movement of said tabs will cause said legs to elastically spread from said engaged position to said open position.

8. The coupling as claimed in claim 1, wherein said shelf surface is disposed on said splines of said projection.

9. The coupling as claimed in claim 1, further comprising a passage extending axially through said hub.

10. The coupling as claimed in claim 1, wherein said projection and said recess are formed with six splines and splineways, said spring retainer having a hexagonal shape.

11. A brush for being removably affixed to a drive hub on a rotatable drive shaft, comprising:

a brush head defining a substantially circular recess for receiving a drive hub, said recess having a plurality of circumferentially spaced splineways for receiving and engaging a corresponding plurality of circumferentially spaced splines formed on the drive hub to prevent relative rotation between said brush head and the hub;

a plurality of bristles affixed to said brush head;

a spring retainer having first and second legs and tabs;

an anchor for mounting a portion of said retainer to said brush head so that said legs cover a diametrically opposed pair of said splineways when said legs are in an initial position; and a laterally extending channel defined by said brush head through which said legs extend for restricting axial motion of said legs with respect to said brush head;..

wherein said legs are adapted to be elastically spread by one of said spaced splines that are formed on the drive hub so that it may be inserted within said recess, said legs being adapted to thereafter engage the drive hub to hold it within said recess, said tabs being manually actuable to elastically spread said legs to an open position in which said legs uncover said opposed pair of splineways, to allow said brush to be easily removed from the hub.

12. The brush as claimed in claim 11, further comprising guide means for preventing relative rotation of said spring retainer with respect to said brush head, such that said legs tend to remain in said initial position.

13. The brush as claimed in claim 11, wherein said legs cross at a point disposed between said legs and said tabs, so that inward movement of said tabs toward each other will cause said legs to elastically spread from said engaged position to said open position.

14. A vehicle for cleaning a surface, comprising:

a plurality of wheels;

powered means for driving said wheels to move said vehicle on said surface;

controls for operating said vehicle;

a removable brush having a brush head and a plurality of bristles;

rotating means,having a drive shaft and a drive hub for rotating said brush;

wherein said brush head is adapted to be removably affixed to said drive hub;

one of said drive hub and said brush having an axially extending projection defining a shelf surface and a cam surface;

a recess defined by the other of said drive hub and said brush head adapted to accept said projection;

said recess and said projection having a plurality of interfitting splines and splineways to prevent relative rotation between said brush head and said drive hub;

a spring retainer, affixed to the other of said drive hub and said brush head having first and second legs and tabs, said legs covering a radially opposed pair of said splineways when said legs are in an initial position; and wherein said cam surface is adapt,ed to elastically spread said legs to allow said projection to be inserted within said recess, said legs thereafter engaging said shelf surface to prevent removal of said projection from said recess, said tabs being manually actuable to elastically spread said legs to an open position in which said legs uncover said opposed pair of splineways, to allow said projection to be easily removed from said recess, said brush being adapted to be similarly reattached to said hub in like manner.

15. The brush as claimed in claim 14, further comprising guide means for preventing relative rotation of said spring retainer with respect to said recess, such that said legs tend to remain in said initial position.

16. The coupling as claimed in claim 14, wherein said shelf surface defines an angle of at least 90 degrees with respect to said shaft when said projection is inserted within said recess, so that said legs tend to continue to engage said shelf surface.

17. The coupling as claimed in claim 14, wherein the other of said drive hub and said brush further comprises an anchor for rigidly affixing a portion of said spring retainer thereto, and a laterally extending channel through which said legs extend for restricting axial motion of said legs relative thereto, while allowing said legs to move laterally, to prevent removal of said projection from said recess.

18. The coupling as claimed in claim 14, wherein said drive shaft is adapted to rotate about a substantially vertical axis.

* * * * *

UNITED STATES PATENT AND TRADEMARK OFFICE

CERTIFICATE OF CORRECTION

PATENT NO. : 5,421,053

DATED : June 6, 1995

INVENTOR(S) : Keith W. Chodak

It is certified that error appears in the above-indentified patent and that said Letters Patent is hereby corrected as shown below:

On the title page, under U.S. Patent Documents, reference 1,933,846, "7/1933" should be — 11/1933 —.

On the title page, under ABSTRACT, line 10, "allow-the" should be — allow the —.

Column 2, line 66, "6,4" shoud be — 64 —.

Column 3, line 6, "6,4" should be — 64 —.

Column 4, line 28, "6,2" should be — 62 —.

Column 5, line 15, delete ".".

Column 6, line 23, delete "..".

Column 6, line 49, delete ",".

Column 6, line 62, delete ",".

Column 6, line 67, "adapt,ed" should be — adapted —.

Signed and Sealed this

Nineteenth Day of September, 1995

*Attest:*

Bruce Lehman

BRUCE LEHMAN

*Attesting Officer*

*Commissioner of Patents and Trademarks*